United States Patent [19]

Cheng

[11] Patent Number: 4,995,185

[45] Date of Patent: Feb. 26, 1991

[54] PICTURE PLATE USING BOTH TRANSPIERCING LIGHT AND REFLECTION LIGHT

[76] Inventor: Chiang-Ming Cheng, 630-1, Diouke, Oaza-okubo, Urawa-shi, Saitama, 338, Japan

[21] Appl. No.: 317,991

[22] Filed: Mar. 2, 1989

[51] Int. Cl.[5] ..... G09F 13/16

[52] U.S. Cl. ..... 40/582; 350/174; 430/11; 430/15

[58] Field of Search ..... 40/582, 562, 561, 559, 40/152.2; 350/174, 144, 172, 321; 428/13, 195; 430/11, 15

[56] References Cited

U.S. PATENT DOCUMENTS

| | | | |
|---|---|---|---|
| 2,880,541 | 4/1959 | Kahn | 430/15 |
| 3,271,149 | 9/1966 | Starck et al. | 430/11 |
| 3,337,341 | 8/1967 | Ryan | 430/15 |
| 3,776,725 | 12/1973 | McCann et al. | 430/15 |
| 3,891,305 | 6/1975 | Fader | 350/144 |
| 4,374,914 | 2/1983 | Mollet et al. | 430/15 |

OTHER PUBLICATIONS

PCT Gazette, Chiang-Ming Cheng, "A Picture Plate Using Both Transpiercing Light and Reflection Light", 8-25-88.

*Primary Examiner*—Peter R. Brown
*Assistant Examiner*—Brian K. Green
*Attorney, Agent, or Firm*—Nutter, McClennen & Fish

[57] ABSTRACT

This invention relates to a picture plate to be used indoor or outdoor for advertisment, display and decoration purposes. The picutre plate comprises of a semitransparent white plate (1) fitted in between the two identical pictures (2) which are matched completely. The picture (2) is affixed to one surface of the semitransparent white plate (1) either by itself, or with a transparent plastic plate (3). A composite picture plate thus formed is capable of exhibiting a clear picture either with the aid of transpiercing light (T) or reflection light (R).

12 Claims, 1 Drawing Sheet

PICTURE PLATE USING BOTH TRANSPIERCING LIGHT AND REFLECTION LIGHT

BACKGROUND OF THE INVENTION

1. Technical Field

This invention is used for indoor and outdoor advertisement, display or decoration. It is concerned about a semitransparent white plastic plate fitted in between two identical pictures to form a composite picture plate. By matching the two pictures, the composite picture plate can exhibit a clear picture with the aid of either transpiercing light or reflection light or both.

2. Background Art

Before this invention, a typical picture plate available in the market uses positive films or is double-transfer printed from pictures of printed matter to a transparent plastic plate where a clear picture can be seen through illumination from the back side by the aid of transpiercing light. Without this illumination from its back side, the picture is too dark to be seen. Also, even when the illumination in the back is on, one can see almost nothing of the picture if the front part of the plate is exposed to bright light or the area immediately facing the front part of the picture plate is bright. Therefore, the hitherto picture plate can only visibly exhibit a picture at night time or inside a fairly lighted room. For this reason, it cannot be used in the bright outdoor.

Another hitherto technique uses pictures printed on poster paper which is seen with the aid of front incident light, i.e., reflection light. This technique, however, cannot show a clear picture when transpiercing light is adapted because its color becomes thinner.

Up to now, there is not any picture plate which can be adapted to indoor or outdoor uses that is capable of exhibiting a clear picture with the aid of both transpiercing light and reflection light.

This invention solves the disadvantages of the hitherto picture plate which cannot use both transpiercing light and reflection light. By and large, this invention can be easily adapted indoor and outdoor and is capable of the dual use of artificial and/or natural light in exhibiting a clear picture, i.e., by using transpiercing light with the aid of an electrical illumination or by using reflection light with the aid of sunlight.

DISCLOSURE OF INVENTION

The reason why the hitherto technique can not use one picture plate that can use both transpiercing light and reflection light is that the picture exhibited by using the former requires twice as dense as the picture that is shown by using reflection light. For this reason, the picture which is of the right density and can be seen by using reflection light will be too thin and will fail to exhibit a clear picture if seen with transpiercing light. Reversely, the picture which is of the right density and can be seen by using transpiercing light will be too dense, making the picture too dark to be seen. Because of the mutual contradiction, the hitherto picture plate can not make use of both transpiercing light and reflection light by using only one picture plate.

In order to use one picture plate with a dual capability of using both transpiercing and reflection lights, the picture of proper density which is clearly seen with the aid of reflection light must simultaneously satisfy the condition whereby the density of the picture seen with transpiercing light is twice the former.

In this invention, a semitransparent white plastic plate is fitted in between two identical pictures. As a result, a clear picture of proper density can be seen with the aid of transpiercing light. When sunlight passes through the picture located on the outer side of the picture plate and hits the semitransparent white plastic plate, the same clear picture as what is printed on the paper can be seen.

Presently, no picture plate available in the market can use both transpiercing light and reflection light. In contrast, this invention has the capacity of using both kinds of lights. The following are other salient characteristics of this invention:

1. This invention is not affected by the location and time of use, i.e. whether or not the immediate surrounding is brightly lighted.
2. With the use of only one picture plate, a clear picture can be seen by using reflection light in bright outdoor during daytime and a clearer and more impressive picture can be seen during night time by using transpiercing light.
3. This invention can be positioned onto a glass window and a clear picture is visible from both inner and outer sides with the aid of reflection light or transpiercing light, regardless of the time of day.
4. The weather-resisting property of the picture plate is high.
5. The water resisting property of the picture plate is good.

MODES FOR CARRYING OUT THE INVENTION

So that the manner in which the above recited features, advantages and objects of the present invention are attained can be understood in detail, more particular description of the invention, briefly summarized above, may be had by reference to the embodiments thereof which are illustrated in the appended drawings.

Figure 1:
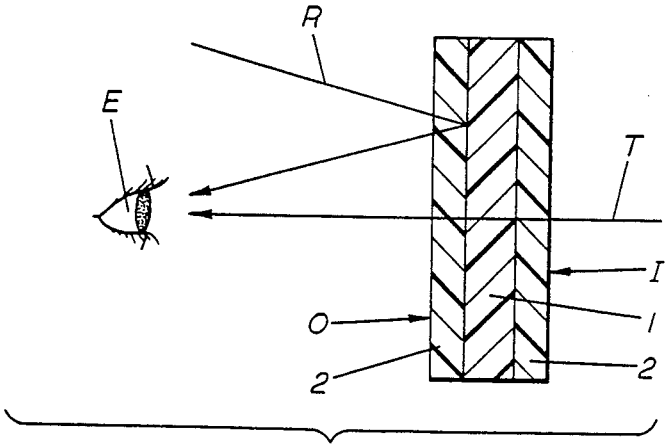
FIG. 1 is the general cross-sectional view of the present invention showing how the transpiercing light and the reflection light are used on the picture plate, and also showing one embodiment of this invention.

Refer to FIG. 1 first which demonstrates the basic configuration of the present invention. As shown in FIG. 1, a semitransparent white plastic plate (1) is fitted in between two identical pictures (2) with the two pictures (2) matched each other completely. Suppose the density of each of the two identical pictures (2) is the same and is equal to C, a clear picture of proper density can be seen with the aid of transpiercing light (T), which passes through the inner side of the picture plate (I), the two pictures (2), and the outer side of the picture plate (O) to reach the eye (E) as the observer is looking through two sheets of identical pictures (2) whose total density is 2C.

On the other hand, when reflection light (R) such as sunlight passes through the picture (2) located on the outer side of the picture plate (O) and hits the semitransparent white plastic plate (2), it bounces the light back to the eye (E), making the density of the picture equal to C, i.e., half the former value. Thus, the same clear picture as what is printed on the paper can be seen.

By using this configuration, a single picture with two identical pictures (2) affixed to a semitransparent white plastic plate (1) can use both transpiercing light (T) and reflection light (R). Moreover, an even clearer picture can be seen with the aid of transpiercing light (T) than what is seen with reflection light (R).

The following are different embodiments of this invention based on the basic configuration demonstrated in FIG. 1. The embodiments are treated in detail with reference to FIGS. 1 through 6. In all the drawings, identical numbers represent the same elements.

First Embodiment

Figure 2:
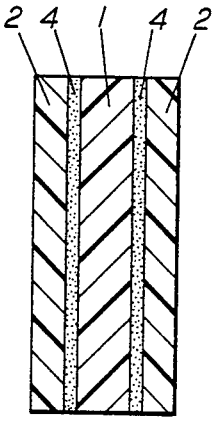
FIGS. 2 through 6 show the cross-sectional view of other embodiments of this invention.

FIG. 2 shows the first embodiment of the invention. It comprises of two identical positive films of a picture (2) and one semitransparent white plastic plate (1) that is fitted in between the two films and glued together with a transparent bonding agent (4) after matching them completely. Thus, a composite picture plate is formed that can use both transpiercing and reflection lights. The positive film can be the pigment emulsion layer of a photograph, which is obtained by removing the background paper from the photographic paper. Alternatively, an electronic photograph can also be used.

Second Embodiment

Figure 3:
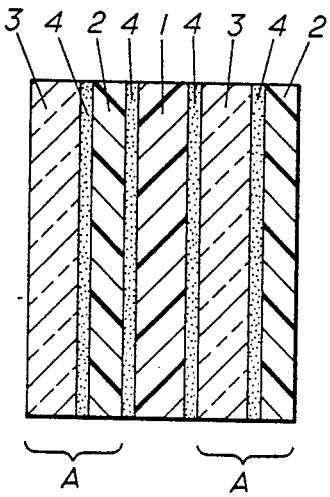

FIG. 3 shows the second embodiment of the present invention. In this embodiment, the picture (2) is transfer printed from printed matter. First, glue the pictured surface of the printed matter to a transparent plastic plate (3) by using a water-insoluble transparent bonding agent (4). After the bonding agent (4) has dried up, use hot water or caustic soda water solution to remove the paper pulp of the printed matter. By doing so, only the ink of picture (2) on the printed matter is left on the transparent plastic plate (3), to form an A-plate (A).

A semitransparent white plastic plate (1) is then fitted in between the identical two A-plates (A). Use a transparent bonding agent (4) to glue them together with the two pictures (2) matched to each other completely. This composite picture plate thus formed can use both transpiercing and reflection lights.

Third Embodiment

The third embodiment of the invention, also demonstrated in FIG. 2, is a variation of the first embodiment. The positive film, as described in the first embodiment, is replaced by a printed matter that is transfer printed on the semitransparent white plastic plate (1). The transfer print method used here is the same as what is discussed in the preceding embodiment. The picture (2) on one side must match completely with the picture (2) on the opposite side of the semitransparent white plastic plate (1).

Fourth Embodiment

Figure 4:
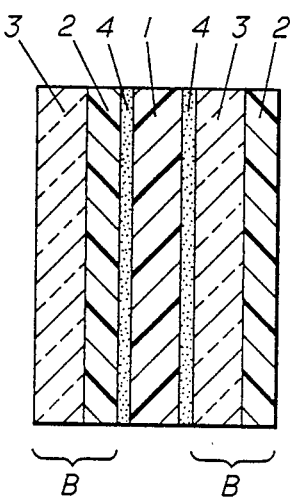

FIG. 4 shows the fourth embodiment of the invention. In this embodiment, the picture plate is constructed as follows. Print a picture (2) onto one side of a transparent plastic plate (3) to form a B-plate (B). The printing process can be done by offset, photogravure, screen process, ink jet, or electronic copy, whichever is desired. A semitransparent white plastic plate (1) is then fitted in between two B-plates (B), with both the clear plastic surfaces of the B-plates facing the same direction.

Use a transparent bonding agent (4) to glue the two B-plates (B) and the semitransparent plate (1) together making sure that the two pictures (2) match completely. Thus, a picture plate is formed that can use both transpiercing and reflection lights.

Fifth Embodiment

The fifth embodiment of the present invention is demonstrated in FIG. 1. By using any printing process used in the fourth embodiment, print two identical pictures (2) on both front and back surfaces of one semitransparent white plastic plate (1) as shown generally in FIG. 1. If it is printed such that the two pictures (2) match completely, then a picture plate is formed that can use both transpiercing and reflection lights.

Sixth Embodiment

Figure 5:
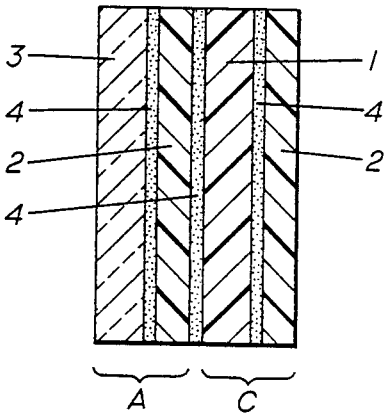

FIG. 5 shows the sixth embodiment of the invention. By using the same printing method described in the second embodiment, transfer print the picture (2) of printed matter to one transparent plastic plate (3) to make A-plate (A). Then, transfer print another identical picture (2) of printed matter to a semitransparent white plastic plate (1) to make C-plate (C). Glue the plates (A, C) together with a transparent bonding agent (4), seeing to it that the pictures (2) are matched completely. Thus, a picture plate is formed that can use both transpiercing and reflection lights.

Seventh Embodiment

Figure 6:
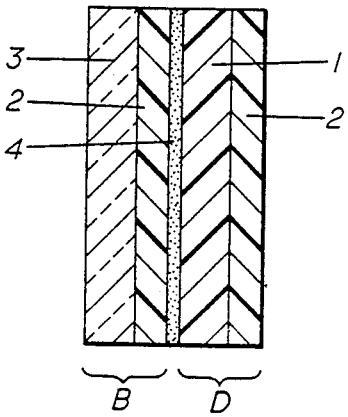

FIG. 6 shows the seventh embodiment of the invention. By using the printing method described in the fourth embodiment, make a B-plate (B) by printing the desired picture (2) to a transparent plastic plate (3). Then make a D-plate (D) by printing the same identical picture (2) directly to a semitransparent white plastic plate (1). Match B-plate (B) and D-plate (D) completely and glue the two plates (B and D) together with a transparent bonding agent (4), seeing to it that the semitransparent white plastic plate (1) is fitted in between the pictures (2). Thus, a picture plate is formed that can use both transpiercing and reflection lights.

The configuration of the picture plates described in the above embodiments generally resembles that in FIG. 1. Both the transparent plastic plate (3) and the transparent bonding agent (4) do not affect the function of the picture plate.

A semitransparent bonding agent can be used to replace the commonly used semitransparent white plastic plate (1) as described in all the above embodiments. Alternately, white cloth or plastic coated cloth can also be used.

To further improve its weather resisting characteristics, a completed picture plate can be pasted or coated with an ultraviolet-ray absorption film.

As discussed above, this invention is not only capable of exhibiting a clear picture by using natural light shone on its front surface, i.e., reflection light, during daytime, but can also deliver the same result by illumination from its back surface, i.e., transpiercing light during night time. Therefore, it is most suitable for display, decoration, and advertisement both indoors and outdoors.

I claim:

1. A device that uses either transpiercing light or reflection light to exhibit a visibly clear picture for both indoor and outdoor advertisement, display, or decoration purposes, said device comprising a semitransparent white plate fitted in between two transparent picture units each of the transparent picture units including one picture, the pictures being identical and in alignment with each other, and means for attaching each of the transparent picture units to the semitransparent white plate.

2. The device in claim 1, wherein each of the transparent picture units comprise a positive film and a transparent bonding agent which is used to affix the positive film to the semitransparent white plastic plate.

3. The device in claim 2, wherein the positive film is a pigment emulsion layer obtained from a photograph with background paper by removing the background paper.

4. The device in claim 1, wherein each of the transparent picture units comprises a transparent plastic plate onto one surface of which the picture is transfer printed from printed matter using a transparent bonding agent.

5. The device in claim 1, wherein each of the transparent picture units comprises a picture transfer printed from printed matter onto one surface of the semitransparent white plate using a transparent bonding agent.

6. The device in claim 1, wherein each of the transparent picture units comprises a transparent plastic plate onto one surface of which the picture is directly printed, and a transparent bonding agent which bonding agent is used to affix the transparent plastic plate directly printed with the picture to the semitransparent white plate.

7. The device in claim 1, wherein each of the transparent picture units comprises the picture directly printed onto one surface of the semitransparent white plate.

8. The device in claim 1, wherein one of the picture units comprises a transparent plastic plate onto one surface of which the picture is transfer printed from printed matter using a first transparent bonding agent, and the other picture unit comprises the picture transfer printed from printed matter onto one surface of the semitransparent white plate using a second transparent bonding agent.

9. The device in claim 1, wherein one of the picture units comprises a transparent plastic plate onto one surface of which a picture is directly printed, and a transparent bonding agent which bonding agent is used to affix the transparent plastic plate directly printed with the picture to one surface of the semitransparent white plate; and the other picture unit comprises a picture directly printed onto the other surface of the semitransparent white plate.

10. The device in claim 1, wherein the semitransparent white plate is made of plastic material.

11. The device in claim 1, wherein the semitransparent white plate is a bonding agent.

12. The device in claim 1, wherein the semitransparent white plate is a piece of white cloth.

* * * * *